US012295492B1

(12) United States Patent
Tong

(10) Patent No.: US 12,295,492 B1
(45) Date of Patent: May 13, 2025

(54) SHELF SUPPORTING APPARATUS WITH SUPPORTING SEAT HAVING SELF-LOCKING FUNCTION

(71) Applicant: Guangdong Oufulong Automatic Shelf Technology Co., Ltd., Guangdong (CN)

(72) Inventor: Fei Tong, Guangdong (CN)

(73) Assignee: Guangdong Oufulong Automatic Shelf Technology Co., Ltd., Zhuhai (CN)

( * ) Notice: Subject to any disclaimer, the term of this patent is extended or adjusted under 35 U.S.C. 154(b) by 0 days.

(21) Appl. No.: 18/507,090

(22) Filed: Nov. 12, 2023

(51) Int. Cl.
*A47B 96/06* (2006.01)
*A47B 96/07* (2006.01)

(52) U.S. Cl.
CPC ..... *A47B 96/07* (2013.01); *A47B 96/061* (2013.01)

(58) Field of Classification Search
CPC ..... A47B 96/07; A47B 96/061; A47B 96/066; A47B 96/06; A47B 96/067
USPC ..... 248/246, 250
See application file for complete search history.

(56) References Cited

U.S. PATENT DOCUMENTS 1,179,166 A * 4/1916 Crist et al. ..... A47B 96/027 248/250
1,210,199 A * 12/1916 Passeck ..... A47B 57/567 5/11
1,230,999 A * 6/1917 Crist ..... A47B 57/565 248/245
1,338,126 A * 4/1920 Erickson ..... B65B 67/12 248/125.3
2,127,280 A * 8/1938 Zimbalist ..... A47B 57/408 248/243
2,713,985 A * 7/1955 Kleckner ..... A47F 3/06 248/243
3,880,256 A * 4/1975 Couris ..... E04G 1/20 182/136
11,627,805 B2 * 4/2023 English ..... A47B 96/07 248/242

FOREIGN PATENT DOCUMENTS

CN 217876729 U 11/2022

* cited by examiner

*Primary Examiner* — Nkeisha Smith

(57) ABSTRACT

The application relates to a shelf supporting apparatus with a supporting seat having a self-locking function, which includes a slide rail and the supporting seat, wherein the supporting seat is slidably and adjustably installed on the slide rail, and is connected to the slide rail through a locking clamping part arranged on the supporting seat to achieve locking; the locking clamping part is installed on the supporting seat through a rotating shaft, the side, facing the supporting seat, of a lower end of the locking clamping part is provided with a first buckle, and the first buckle is connected to the supporting seat in a buckled manner when the locking clamping part is connected to the slide rail to achieve locking, so that self-locking is achieved, loosening generated after the locking clamping part and the slide rail are connected in a locked manner is effectively avoided.

13 Claims, 6 Drawing Sheets

SHELF SUPPORTING APPARATUS WITH SUPPORTING SEAT HAVING SELF-LOCKING FUNCTION

TECHNICAL FIELD

The application belongs to the technical field of shelf installation and fixing, and particularly relates to a shelf supporting apparatus with a supporting seat having a self-locking function.

BACKGROUND

A shelf, as a main component of a freezer and a goods shelf, is configured to hold commodities and goods. However, the shelf of the existing freezer and goods shelf has a fixed and non-adjustable position, which limits the placed commodities and goods, and is extremely inconvenient to use. Therefore, an adjustable supporting apparatus for the shelf has appeared on the market. The adjustable supporting apparatus includes a slide rail and the supporting seat, the supporting seat being slidably and adjustably installed on the slide rail, and being connected to the slide rail through a locking clamping part arranged on the supporting seat to achieve locking. However, the applicant found that: loosening is easily caused after the locking clamping part and the slide rail of these existing adjustable supporting apparatuses are connected in a locked manner, resulting in poor reliability. For example, during the process of placing the commodities and goods on the shelf, due to the vibration of the shelf, the locking clamping part and the slide rail are prone to loosening, resulting in tilting or even dropping of the shelf. As a result, some manufacturers have added a metal pin to the supporting seat, that is, after the supporting seat is adjusted, and the locking clamping part and the slide rail are connected in a locked manner, the metal pin transversely passes through the supporting seat, so that the metal pin is tightly pressed and attached to the locking clamping part. Although the above problems are solved, the use of the solution not only increases the cost, but also makes the operation become complicated and inconvenient.

SUMMARY

In order to solve the above problems in the related art, the application provides a shelf supporting apparatus with a supporting seat having a self-locking function.

In order to solve the above technical problems, the technical solution adopted by the application is as follows.

A shelf supporting apparatus with a supporting seat having a self-locking function includes a slide rail and the supporting seat. The supporting seat is slidably and adjustably installed on the slide rail, and is connected to the slide rail through a locking clamping part arranged on the supporting seat to achieve locking. The locking clamping part is installed on the supporting seat through a rotating shaft, the side, facing the supporting seat, of a lower end of the locking clamping part is provided with a first buckle, and the first buckle is connected to the supporting seat in a buckled manner when the locking clamping part is connected to the slide rail to achieve locking, so that self-locking is achieved.

Further, a corresponding position of the supporting seat is provided with a second buckle, and the first buckle and the second buckle are buckled with each other when the locking clamping part is connected to the slide rail to achieve locking.

Further, the first buckle and the second buckle are inverted buckles which are matched with each other, or the inverted buckle and a buckled clamping position which are matched with each other, or the inverted buckle and a buckled clamping block which are matched with each other.

Further, a front surface of the supporting seat is provided with a cavity communicating with a back surface, an upper end of the locking clamping part is provided with a rotating shaft seat, the locking clamping part is rotatably installed in the cavity through a rotating shaft penetrating through the rotating shaft seat, and a lower end of the locking clamping part is bent outwards to extend out of the cavity, and is provided with the first buckle.

Further, an outer surface of the rotating shaft seat is provided with a curved elastic part, and the curved elastic part abuts against a cavity wall of an upper end of the cavity.

Further, the outer surface of the rotating shaft seat is further provided with a protruding block, and the protruding block, after the locking clamping part is separated from the slide rail to achieve unlocked, abuts against the cavity wall of the upper end of the cavity.

Further, the first buckle, the rotating shaft seat, the curved elastic part, the protruding block, and the locking clamping part are of an integrated structure.

Further, the slide rail is provided with a plurality of through holes in a length direction, a surface of the side, facing the slide rail, of the locking clamping part is provided with a protruding column, and the protruding column is inserted into the corresponding through hole after the sliding adjustment of the supporting seat.

Further, the through holes are square holes, and the protruding column is a square column matched with the square hole.

Further, an upper end of the supporting seat is provided with a shelf installation position, the side, close to the slide rail, of the installation position is provided with a positioning baffle, and the positioning baffle is provided with a limiting hole. The side, opposite to the positioning baffle, of the installation position is provided with a locking curved bar. The locking curved bar is able to move up and down and rotatably installed on the supporting seat. When one end of the locking curved bar stretches across the installation position and moves up to be clamped into the limiting hole, locking is achieved. When one end of the locking curved bar moves down and moves out of the limiting hole, unlocking is achieved.

Further, an upper end of the supporting seat is provided with the shelf installation position. The side, close to the slide rail, of the installation position is provided with the positioning baffle. The positioning baffle is provided with a protruding limit stop block and two protruding limit strips. The two protruding limit strips are separated in parallel and upper ends thereof extend to the protruding limit stop block to form a curved bar anti-disengagement locking groove. The side, opposite to the positioning baffle, of the installation position is provided with the locking curved bar. The locking curved bar is able to move up and down and rotatably installed on the supporting seat. When one end of the locking curved bar stretches across the installation position and moves up to be clamped into the curved bar anti-disengagement locking groove, or is close to or reaches the protruding limit stop block, one end of the locking curved bar abuts against a bottom surface of the curved bar anti-disengagement locking groove to achieve locking. When one end of the locking curved bar moves down and moves out of the curved bar anti-disengagement locking groove, unlocking is achieved.

Further, one end, located in the curved bar anti-disengagement locking groove, of the protruding limit stop block is provided with a bayonet, the two protruding limit strips are respectively located on left and right sides of the bayonet, and the upper ends of the two protruding limit strips are respectively connected to the protruding limit stop block abutting against the left and right sides of the bayonet. When the locking curved bar moves up to be locked, the end of the locking curved bar is clamped into the bayonet.

Further, the protruding limit stop block is an arc protruding block, and is provided with a downward inclined surface, configured to guide a chassis of a shelf into the shelf installation position arranged on the upper end of the supporting seat.

Further, a front surface of the supporting seat is provided with a cavity communicating with a back surface, one end, located in the cavity, of the locking curved bar is provided with an operating part, and the operating part is circular.

The application has the following beneficial effects.

In the application, the first buckle is connected to the supporting seat in a buckled manner when the locking clamping part is connected to the slide rail to achieve locking, so that self-locking is achieved, loosening generated after the locking clamping part and the slide rail are connected in a locked manner is effectively avoided, the locking reliability of the supporting seat on the slide rail is further enhanced, and the use safety is higher.

Figure 1:
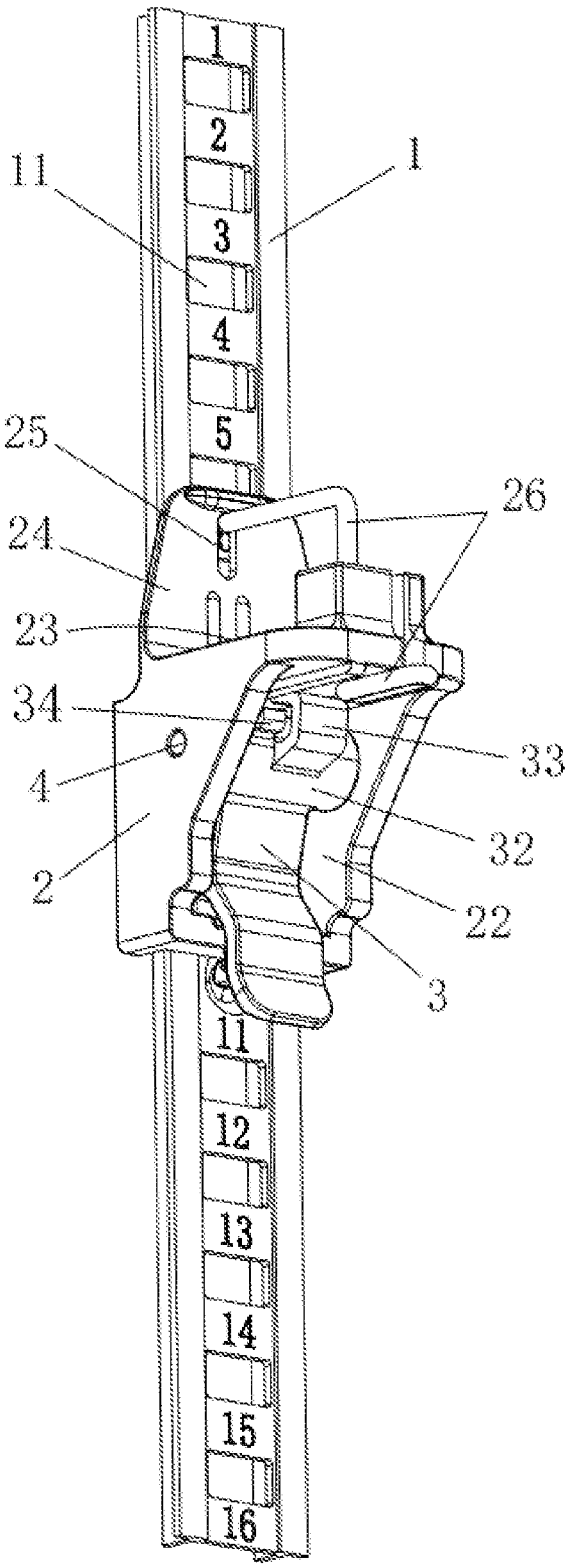
FIG. 1 is a schematic structural diagram of Embodiment 1 of a shelf supporting apparatus with a supporting seat having a self-locking function of the application.

Illustration of reference signs: 1. Slide rail, 11. Through hole, 2. Supporting seat, 21. Second buckle, 22. Cavity, 23. Shelf installation position, 24. Positioning baffle, 25. Limiting hole, 26. Locking curved bar, 261. End, 262. Operating part, 27. Protruding limit stop block, 271. Bayonet, 272. Inclined surface, 28. Protruding limit strip, 29. Curved bar anti-disengagement locking groove, 3. Locking clamping part, 31. First buckle, 32. Rotating shaft seat, 33. Curved elastic part. 34. Protruding block, 35. Protruding column, and 4. Rotating shaft.

DETAILED DESCRIPTION OF THE EMBODIMENTS

In order to make the purposes, technical solutions and advantages of the application clearer, the application will be further described below in detail in conjunction with the accompanying drawings and embodiments. It is to be understood that the specific embodiments described herein are only used to illustrate the application, but are not intended to limit the application.

Embodiment 1

Referring to FIGS. 1 to 4, the application provides a shelf supporting apparatus with a supporting seat having a self-locking function, which includes a slide rail 1 and a supporting seat 2. The supporting seat 2 is slidably and adjustably installed on the slide rail 1, and is connected to the slide rail 1 through a locking clamping part 3 arranged on the supporting seat to achieve locking.

In a possible implementation, the slide rail 1 is provided with a plurality of through holes 11 in a length direction, a surface of the side, facing the slide rail 1, of the locking clamping part 3 is provided with a protruding column 35, and the protruding column 35 is inserted into the corresponding through hole 11 after the sliding adjustment of the supporting seat 2, so as to achieve locking of the supporting seat 2 on the slide rail 1.

Further, the through holes 11 may be square holes, correspondingly, the protruding column 35 is a square column matched with the square hole, on the one hand, the locking stability and reliability are improved, and on the other hand, the bearing capacity of the apparatus on a shelf is improved. Moreover, in order to further improve the smoothness of adjustment of the supporting seat 2 on the slide rail 1 and the accuracy of insertion into the through holes 11, upper and lower ends of an end surface of the square column are arc-shaped.

Referring to FIGS. 1 to 4 again, the locking clamping part 3 is installed on the supporting seat 2 through a rotating shaft 4, the side, facing the supporting seat 2, of a lower end of the locking clamping part 3 is provided with a first buckle 31, and the first buckle 31 is connected to the supporting seat 2 in a buckled manner when the locking clamping part 3 is connected to the slide rail 1 to achieve locking, so that self-locking is achieved, loosening generated after the locking clamping part 3 and the slide rail 1 are connected in a locked manner (after the protruding column 35 is inserted into the through hole 11) is effectively avoided, the locking reliability of the supporting seat 2 on the slide rail 1 is further enhanced, and the use safety is higher.

In a possible implementation, a corresponding position of the supporting seat 2 is provided with a second buckle 21, and the first buckle 31 and the second buckle 21 are buckled with each other when the locking clamping part 3 is connected to the slide rail 1 to achieve locking.

Figure 2:
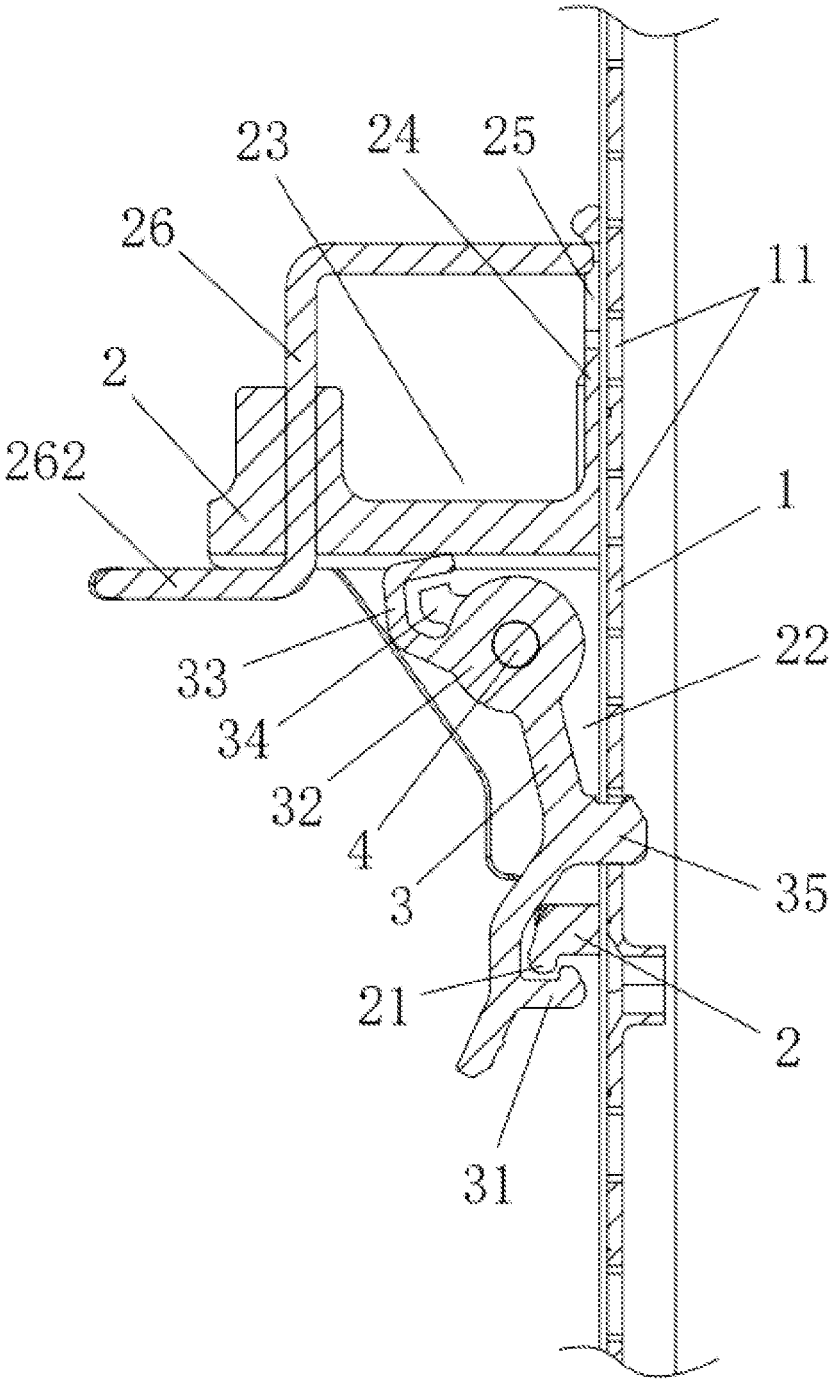
FIG. 2 is a schematic sectional view of a local structure of Embodiment 1 of a shelf supporting apparatus with a supporting seat having a self-locking function of the application.
Figure 4:
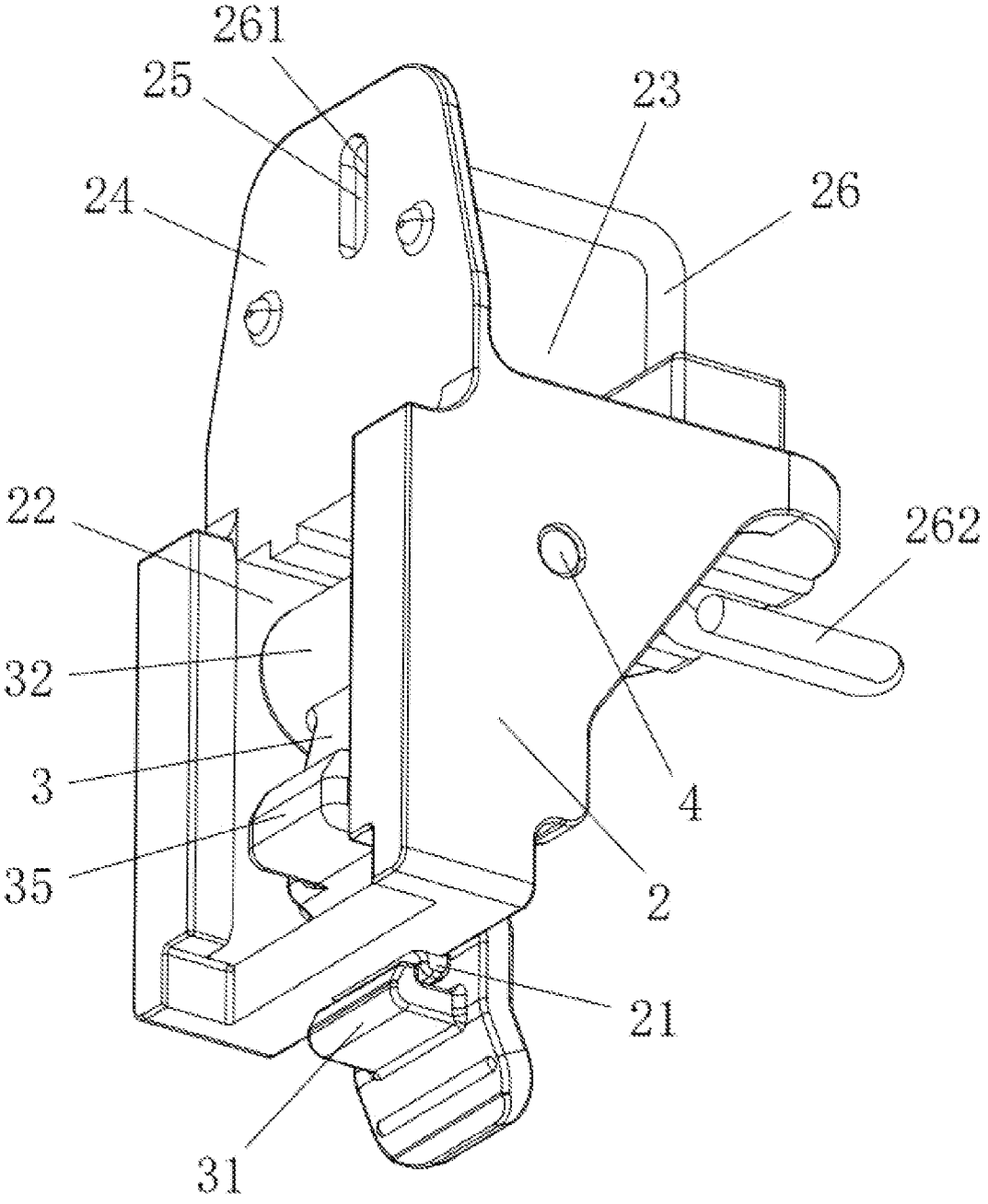
FIG. 4 is another schematic structural diagram of a supporting seat in Embodiment 1 of a shelf supporting apparatus with a supporting seat having a self-locking function of the application.

Further, as shown in FIG. 2 and FIG. 4, the first buckle 31 and the second buckle 21 are an inverted buckle and a buckled clamping block which are matched with each other. When the locking clamping part 3 is connected to the slide rail 1 to achieve locking (that is, the protruding column 35 is inserted into the through hole 11), the inverted buckle is buckled on the clamping block to achieve locking of the locking clamping part 3. Specifically, a front surface of the supporting seat 2 is provided with a cavity 22 communicating with a back surface, an upper end of the locking clamping part 3 is provided with a rotating shaft seat 32, the locking clamping part 3 is rotatably installed in the cavity 22 through a rotating shaft 4 penetrating through the rotating shaft seat 32, and a lower end of the locking clamping part is bent outwards to extend out of the cavity 22, and is provided with the first buckle 31.

Of course, the first buckle 31 and the second buckle 21 are the inverted buckles which are matched with each other, or the inverted buckle and a buckled clamping position which are matched with each other.

Figure 3:
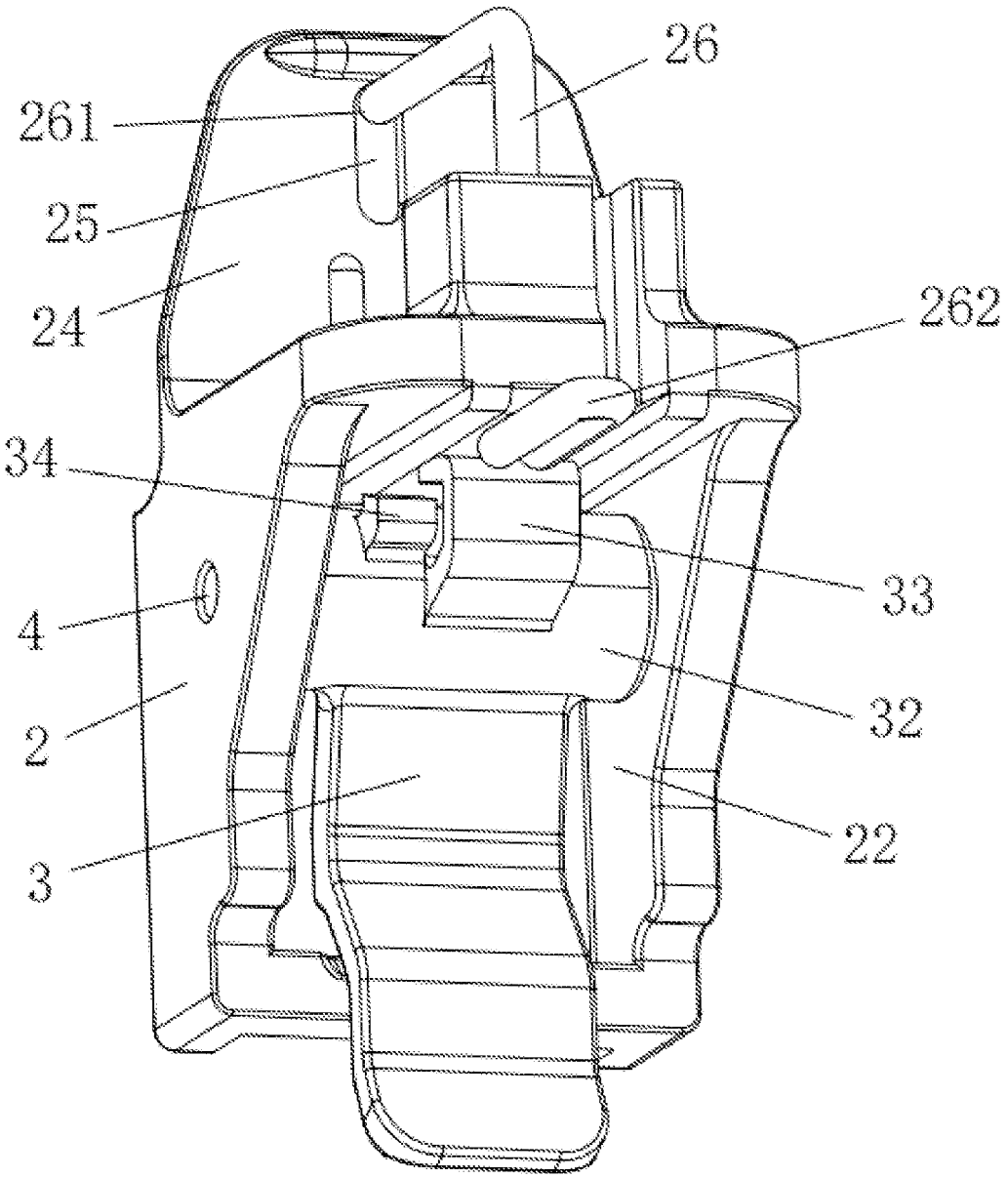
FIG. 3 is a schematic structural diagram of a supporting seat in Embodiment 1 of a shelf supporting apparatus with a supporting seat having a self-locking function of the application.

Referring to FIGS. 1 to 3, an outer surface of the rotating shaft seat 32 is provided with a curved elastic part 33, the curved elastic part 33 may be U-shaped, and the curved elastic part 33 abuts against a cavity wall of an upper end of the cavity 22. When the supporting seat 2 is slidably adjusted on the slide rail 1, the curved elastic part 33 is in an extrusion deformation state, so that the protruding column 35 of the locking clamping part 3 is always in contact connection with a surface of the slide rail 1. When the protruding column 35 slides to the through hole 11, the curved elastic part 33 in the extrusion deformation state enables an end of the protruding column 35 to be placed in the through hole 11, on the one hand, the hand feeling of the sliding adjustment of the supporting seat 2 is improved, and on the other hand, the alignment of the protruding column 35 with the through hole 11 is automatically completed in the process of the sliding adjustment of the supporting seat 2, and the locking operation is more convenient and faster.

Referring to FIGS. 1 to 3 again, the outer surface of the rotating shaft seat 32 is further provided with a protruding block 34, and after the locking clamping part 3 rotates and is separated from the slide rail to achieve unlocking, the protruding block 34 abuts against the cavity wall of the upper end of the cavity 22, so that the damage or failure of the curved elastic part 33 caused by too large extrusion deformation on the curved elastic part 33 due to excessive rotation of the locking clamping part 3 is avoided, and the curved elastic part 33 is effectively protected.

In addition, in the application, the first buckle 31, the rotating shaft seat 32, the curved elastic part 33, the protruding block 34, and the locking clamping part 3 are of an integrated structure, for example, the first buckle 31, the rotating shaft seat 32, the curved elastic part 33, the protruding block 34, and the locking clamping part 3 are integrally formed by injection molding. Therefore, the structure may be simplified and the assembly efficiency may be improved.

Referring to FIGS. 1 to 4, an upper end of the supporting seat 2 is provided with a shelf installation position 23, and the shelf installation position 23 is located above the cavity 22. The side, close to the slide rail 1, of the installation position 23 is provided with a positioning baffle 24, and the positioning baffle 24 is provided with a limiting hole 25. The side, opposite to the positioning baffle 24, of the installation position 23 is provided with a locking curved bar 26. The locking curved bar 26 is able to move up and down and rotatably installed on the supporting seat 2, and one end of the locking curved bar stretches across the installation position 23 and is able to move up and down to be clamped into the limiting hole 25. Specifically, the locking curved bar 26 is able to move up and down and rotatably penetrates through the supporting seat 2 between the shelf installation position 23 and the cavity 22, the part, located at the installation position 23, of the locking curved bar 26 stretches across the installation position 23, and the end 261 is able to move up and down to be clamped into the limiting hole 25, that is, when one end of the locking curved bar 26 stretches across the installation position 23 and moves up to be clamped into the limiting hole 25, locking is achieved. When one end of the locking curved bar 26 moves down and moves out of the limiting hole 25, unlocking is achieved. The positioning baffle 24 needs to be manually pulled backward in the unlocking process, and one end, located in the cavity 22, of the locking curved bar 26 is provided with an operating part 262. In this way, the shelf may be firmly locked on the installation position 23 of the apparatus by the locking curved bar 26, and the limiting hole 25 not only avoids the locking curved bar 26 from mistakenly rotating and unlocking, but also enables the locking curved bar 26 to move up and down more stably, thereby playing a role in limiting and guiding.

Embodiment 2

Figure 5:
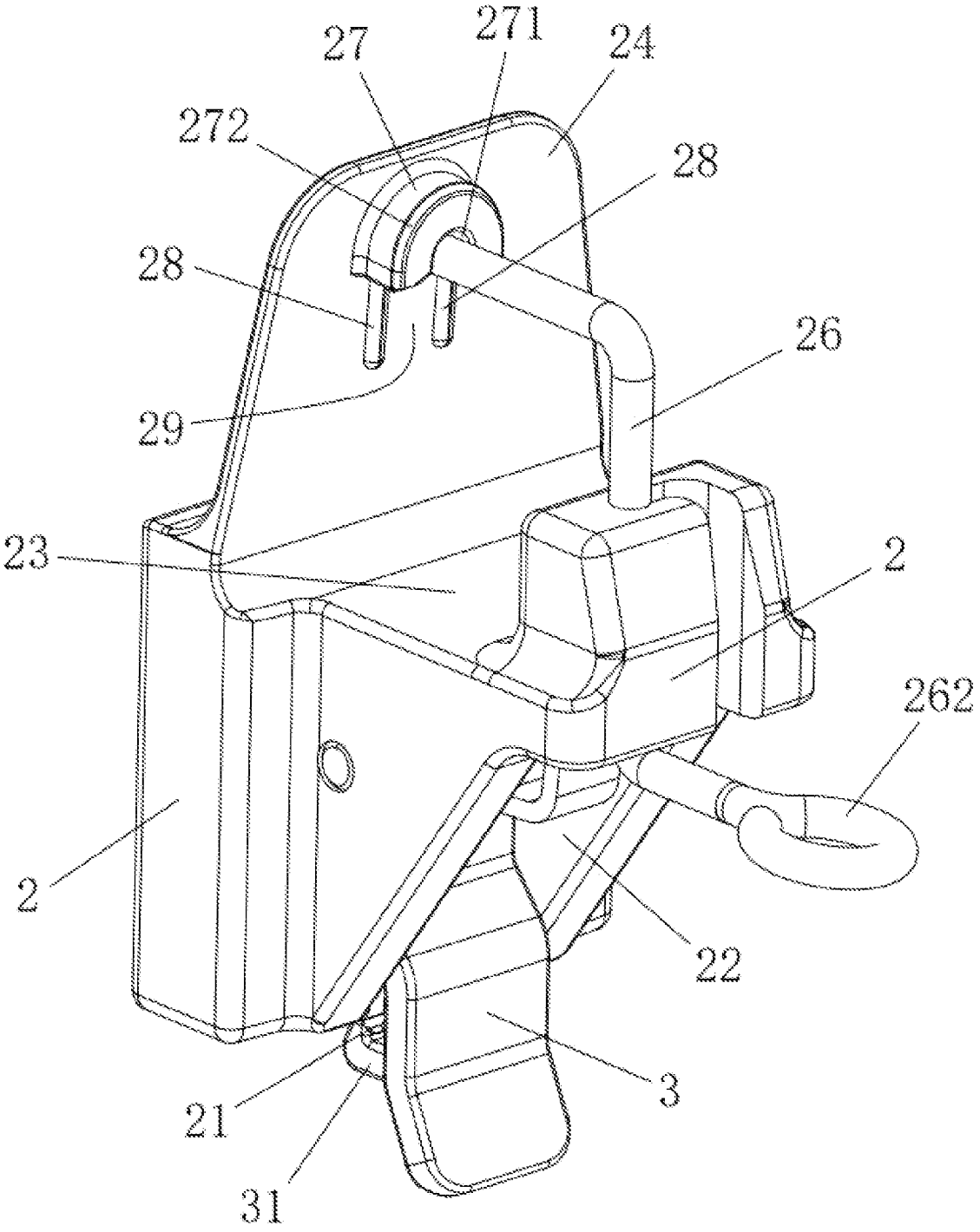
FIG. 5 is a schematic structural diagram of Embodiment 2 of a shelf supporting apparatus with a supporting seat having a self-locking function of the application.
Figure 6:
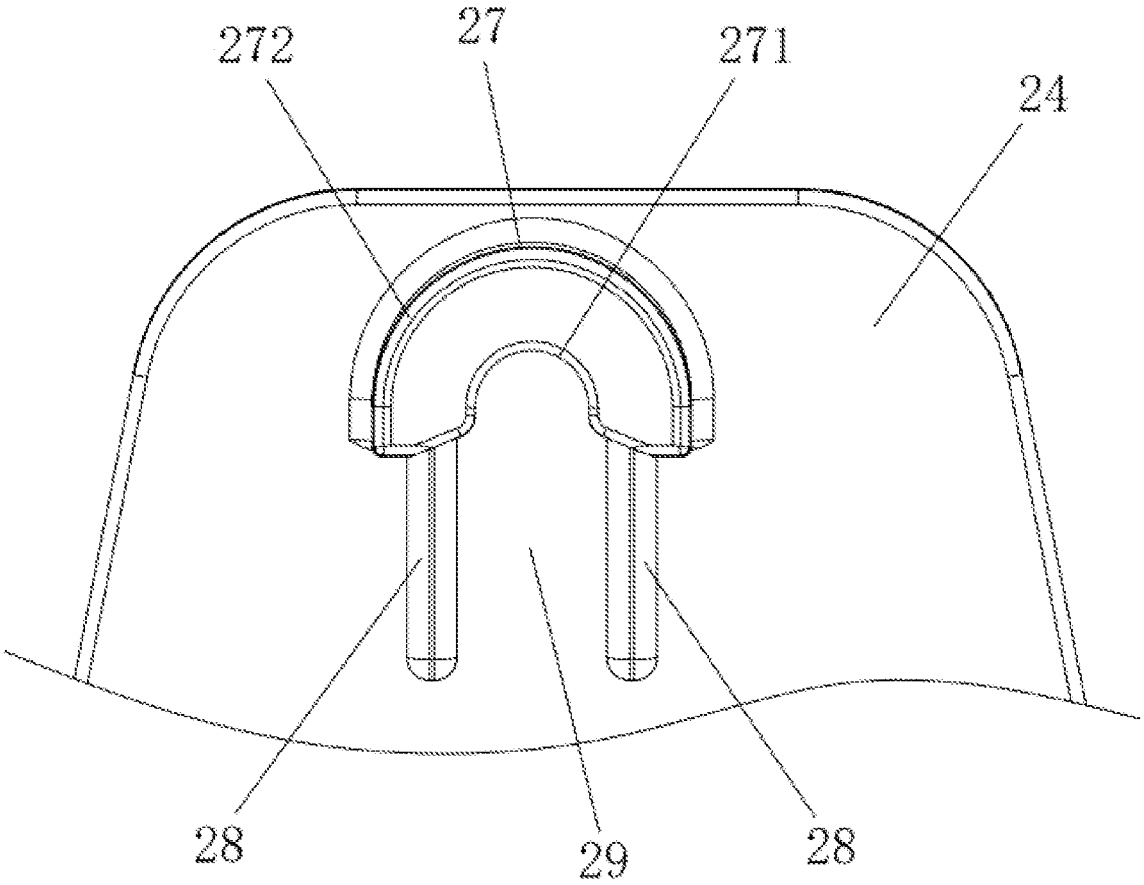
FIG. 6 is a schematic sectional view of a local structure of Embodiment 2 of a shelf supporting apparatus with a supporting seat having a self-locking function of the application.

Referring to FIG. 5 and FIG. 6, the structure and working principle of a shelf supporting apparatus with a supporting seat having a self-locking function in Embodiment 2 of the application are basically the same as that of Embodiment 1, including a slide rail (not shown in the figure) and a supporting seat 2. The supporting seat 2 is slidably and adjustably installed on the slide rail, and is connected to the slide rail through a locking clamping part 3 arranged on the supporting seat to achieve locking. An upper end of the supporting seat 2 is provided with a shelf installation position 23. The side, close to the slide rail 1, of the installation position 23 is provided with a positioning baffle 24. The side, opposite to the positioning baffle 24, of the installation position 23 is provided with a locking curved bar 26. The locking curved bar 26 is able to move up and down and rotatably installed on the supporting seat 2. The differences from Embodiment 1 are only that: the positioning baffle 24 is provided with a protruding limit stop block 27 and two protruding limit strips 28, the protruding height of the protruding limit stop block 27 is more than 1 mm, the two protruding limit strips 28 are separated in parallel and upper ends thereof extend to the protruding limit stop block 27 to form a curved bar anti-disengagement locking groove 29. When one end of the locking curved bar 26 stretches across the installation position 23 and moves up to be clamped into the curved bar anti-disengagement locking groove 29, or is close to or reaches the protruding limit stop block 27, one end of the locking curved bar 26 abuts against a bottom surface of the curved bar anti-disengagement locking groove 29 to achieve locking. When one end of the locking curved bar 26 moves down and moves out of the curved bar anti-disengagement locking groove 29, unlocking is achieved. In this way, in Embodiment 2, the locking curved bar 26 does not need to manually pull the positioning baffle 24 backward as in Embodiment 1 in the unlocking process, and the operation is more convenient and faster, the problem of loosening caused by a violent impact of the shelf on the locking curved bar 26 due to the vibration of a freezer in the transportation process is effectively avoided, and meanwhile, the protruding limit stop block 27 and the two protruding limit strips 28 also play a role in enhancing the strength of the positioning baffle 24, so that the locking performance of the shelf is improved.

In a preferred solution of the embodiment, one end, located in the curved bar anti-disengagement locking groove 29, of the protruding limit stop block 27 is provided with a bayonet 271, the bayonet 271 is preferably a circular bayonet with a clamping port slightly less than the diameter, the two protruding limit strips 28 are respectively located on left and right sides of the bayonet 271, and the upper ends of the two protruding limit strips 28 are respectively connected to the protruding limit stop block 27 abutting against the left and right sides of the bayonet 271. When an operating part 262 of the locking curved bar 26 is operated to move the locking curved bar 26 up to be in a locked state, the end of the locking curved bar 26 is clamped into the bayonet 271, and the locking effect is stable, reliable. After a reverse operation, the locking curved bar 26 moves down and moves out of the bayonet 271, that is, unlocking is achieved, and the operation is simple, convenient and fast.

In another preferred solution of the embodiment, the protruding limit stop block 27 is an arc protruding block, and is provided with a downward inclined surface 272, configured to guide a chassis of the shelf into the shelf installation position 23 arranged on the upper end of the supporting seat 2, so that the shelf installation is more convenient.

In addition, the operating part 262 of the application is circular, as shown in FIG. 5 of Embodiment 2, and the operating part 262 is ring-shaped. Of course, the operating part in Embodiment 2 may also be designed to be circular. By using the ring operating part 262, on the one hand, holding is facilitated, and the operation is convenient, and on the other hand, the acting force of the operating part 262 on the hand during the operation is dispersed, thereby avoiding pain and improving the experience.

The above description is merely preferred implementations of the application, and it is to be noted that those of ordinary skill in the art may also make several improvements and refinements without departing from the principle of the application, and it should be considered that these improvements and refinements shall all fall within the scope of protection of the application.

What is claimed is:

1. A shelf supporting apparatus with a supporting seat having a self-locking function, comprising a slide rail and the supporting seat, wherein the supporting seat is slidably and adjustably installed on the slide rail, and is connected to the slide rail through a locking clamping part arranged on the supporting seat to achieve locking, wherein the locking clamping part is installed on the supporting seat through a rotating shaft, a side, facing the supporting seat, of a lower end of the locking clamping part is provided with a first buckle, and the first buckle is connected to the supporting seat when the locking clamping part is connected to the slide rail to achieve locking, so that self-locking is achieved;

wherein a corresponding position of the supporting seat is provided with a second buckle, and the first buckle and the second buckle are buckled with each other when the locking clamping part is connected to the slide rail to achieve locking.

2. The shelf supporting apparatus with the supporting seat having the self-locking function according to claim 1, wherein the first buckle and the second buckle are inverted buckles which are matched with each other, or the inverted buckle and a buckled clamping position which are matched with each other, or the inverted buckle and a buckled clamping block which are matched with each other.

3. The shelf supporting apparatus with the supporting seat having the self-locking function according to claim 1, wherein a front surface of the supporting seat is provided with a cavity communicating with a back surface, an upper end of the locking clamping part is provided with a rotating shaft seat, the locking clamping part is rotatably installed in the cavity through a rotating shaft penetrating through the rotating shaft seat, and a lower end of the locking clamping part is bent outwards to extend out of the cavity, and is provided with the first buckle.

4. The shelf supporting apparatus with the supporting seat having the self-locking function according to claim 3, wherein an outer surface of the rotating shaft seat is provided with a curved elastic part, and the curved elastic part abuts against a cavity wall of an upper end of the cavity.

5. The shelf supporting apparatus with the supporting seat having the self-locking function according to claim 4, wherein the outer surface of the rotating shaft seat is further provided with a protruding block, and the protruding block, after the locking clamping part is separated from the slide rail to achieve unlocking, abuts against the cavity wall of the upper end of the cavity.

6. The shelf supporting apparatus with the supporting seat having the self-locking function according to claim 1, wherein the slide rail is provided with a plurality of through holes in a length direction, a surface of a side, facing the slide rail, of the locking clamping part is provided with a protruding column, and the protruding column is inserted into a corresponding through hole after a sliding adjustment of the supporting seat.

7. The shelf supporting apparatus with the supporting seat having the self-locking function according to claim 6, wherein the through holes are square holes, and the protruding column is a square column matched with the square hole.

8. The shelf supporting apparatus with the supporting seat having the self-locking function according to claim 1, wherein an upper end of the supporting seat is provided with a shelf installation position, a side, close to the slide rail, of the installation position is provided with a positioning baffle, and the positioning baffle is provided with a limiting hole:

a side, opposite to the positioning baffle, of the installation position is provided with a locking curved bar; the locking curved bar is able to move up and down and rotatably installed on the supporting seat; when one end of the locking curved bar stretches across the installation position and moves up to be clamped into the limiting hole, locking is achieved; and when one end of the locking curved bar moves down and moves out of the limiting hole, unlocking is achieved.

9. The shelf supporting apparatus with the supporting seat having the self-locking function according to claim 8, wherein a front surface of the supporting seat is provided with a cavity communicating with a back surface, one end, located in the cavity, of the locking curved bar is provided with an operating part, and the operating part is circular.

10. The shelf supporting apparatus with the supporting seat having the self-locking function according to claim 1, wherein an upper end of the supporting seat is provided with a shelf installation position; a side, close to the slide rail, of the installation position is provided with a positioning baffle; the positioning baffle is provided with a protruding limit stop block and two protruding limit strips; the two protruding limit strips are separated in parallel and upper ends thereof extend to the protruding limit stop block to form a curved bar anti-disengagement locking groove:

a side, opposite to the positioning baffle, of the installation position is provided with a locking curved bar; the locking curved bar is able to move up and down and rotatably installed on the supporting seat; when one end of the locking curved bar stretches across the installation position and moves up to be clamped into the curved bar anti-disengagement locking groove, or is close to or reaches the protruding limit stop block, one end of the locking curved bar abuts against a bottom surface of the curved bar anti-disengagement locking groove to achieve locking; and when one end of the locking curved bar moves down and moves out of the curved bar anti-disengagement locking groove, unlocking is achieved.

11. The shelf supporting apparatus with the supporting seat having the self-locking function according to claim 10, wherein one end, located in the curved bar anti-disengagement locking groove, of the protruding limit stop block is provided with a bayonet, the two protruding limit strips are respectively located on left and right sides of the bayonet, and the upper ends of the two protruding limit strips are respectively connected to the protruding limit stop block abutting against the left and right sides of the bayonet; and when the locking curved bar moves up to be locked, the end of the locking curved bar is clamped into the bayonet.

12. The shelf supporting apparatus with the supporting seat having the self-locking function according to claim 11, wherein the protruding limit stop block is an arc protruding block, and is provided with a downward inclined surface, configured to guide a chassis of a shelf into the installation position of the shelf arranged on the upper end of the supporting seat.

13. The shelf supporting apparatus with the supporting seat having the self-locking function according to claim 10, wherein a front surface of the supporting seat is provided with a cavity communicating with a back surface, one end, located in the cavity, of the locking curved bar is provided with an operating part, and the operating part is circular.

* * * * *